US005597135A

United States Patent [19]

Vandersteene

[11] Patent Number: 5,597,135

[45] Date of Patent: Jan. 28, 1997

[54] FITTING PIECE FOR ATTACHING AND LOCKING A FREELY-ROTATING REPLACEMENT ROLLER

[75] Inventor: Eric Vandersteene, Gent, Belgium

[73] Assignee: American Biltrite, Inc., Wellesley Hills, Mass.

[21] Appl. No.: 144,122

[22] Filed: Oct. 28, 1993

[30] Foreign Application Priority Data

Oct. 29, 1992 [BE] Belgium ..... 09200938

[51] Int. Cl.[6] ..... B65H 75/02

[52] U.S. Cl. ..... 242/599.4; 242/599.3

[58] Field of Search ..... 242/596, 599, 242/599.3, 599.4, 612, 613.4; 384/276, 297, 299, 300, 418, 428

[56] References Cited

U.S. PATENT DOCUMENTS

| | | | |
|---|---|---|---|
| 3,521,833 | 7/1970 | Ridgeway et al. | 242/613.4 X |
| 3,703,996 | 11/1972 | Ulseth | 242/599 |
| 4,063,689 | 12/1974 | Brovelli | 242/599.4 X |
| 4,792,105 | 12/1988 | Imaseki | 242/599.3 X |
| 4,834,312 | 5/1989 | Riemenschneider . | |

FOREIGN PATENT DOCUMENTS

| | | |
|---|---|---|
| A0499761 | 8/1992 | European Pat. Off. . |
| 7714640 | 10/1977 | Germany . |
| 9108917 | 11/1991 | Germany . |
| 60-106767 | 6/1985 | Japan . |

*Primary Examiner*—John P. Darling
*Attorney, Agent, or Firm*—Amster, Rothstein & Ebenstein

[57] ABSTRACT

A fitting piece provides a freely-rotating replacement roll with a specific attachment point which is suitable for securing spindles of the freely-rotating replacement roll when one of the two spindles is a cylindrical sleeve (6) in which a freely-rotating plug (4) is inserted, the foot of which is equipped with elastically-suspended cams (11) in order to clamp the plug along the longitudinal axis of the sleeve (6) and the head (7) equipped with a notch (8) or a recess (9) which specifically fits into an attachment point of a roll-holder.

6 Claims, 2 Drawing Sheets

FITTING PIECE FOR ATTACHING AND LOCKING A FREELY-ROTATING REPLACEMENT ROLLER

BACKGROUND OF THE INVENTION

1. Field of the invention

This invention concerns a fitting piece for attaching and locking a replacement roll, disc, reel or removable drum which freely rotates on a shaft, in an apparatus which has two attachment points and/or locking points for the above-mentioned shaft.

It is used in apparatus which distribute paper, plastic film or wire, especially in machines which enable a user to apply application tape in order to transfer text or logos cut out from adhesive vinyl foil onto a final carrier.

The invention mainly concerns a plug which is suitable for securing a removable paper roll, plastic strip or adhesive tape in a roll-holder.

DESCRIPTION OF THE PRIOR ART

Well-known consumable items which are available to the public require regular replacement in numerous apparatus and applications which are protected by a patent. This particularly applies to rolls of paper, rolls of plastic film, cassettes, adhesive tape dispensers, bobbins and/or reels on which various materials are wound.

Each roll usually has a cylindrical core consisting of, for example, a hollow cardboard core which has a constant cross-section and which rotates along its longitudinal axis. A roll of paper, plastic film, textiles or wire are wound onto the core. Each end of the cylindrical core is provided with a sleeve or nipple-shaped plug equipped with a spindle which extends coaxially in relation to the end of the cardboard tube and is designed to be placed inside or inserted into a cup or a recess which has a semi-circular bottom which is intended for use as a roll-holder, so that the roll can rotate freely on these spindles. The suspension system for the roll is well-known and is available to the public.

As everyone is permitted to manufacture spare parts which are available to the public, as long as the intention is not to directly or indirectly reconstruct the patented apparatus, but only to supply the above-mentioned spare parts to the purchaser, the protection which has been requested concerns a specific suspension system for the spare part itself.

SUMMARY OF THE INVENTION

The purpose of this invention is to develop a fitting piece for a suspension system in order to grant or guarantee a sales right for replacement rolls which themselves do not possess any new characteristics apart from a special provision where the support can enter.

This invention uses a fitting piece for securing and locking a replacement roll of the type previously described in the first paragraph of this specification.

This fitting piece is characterized by the fact that at least one of the two spindles is a cylindrical sleeve in which a freely-rotating plug is mounted. The foot of this plug is equipped with elastically-suspended cams which serve to clamp the plug along the longitudinal axis of the sleeve, and also to provide the head with a notch or hole which fits in a specific manner into an attachment point on a roll-holder.

One special characteristic of the invention is that the cylindrical sleeve is secured or glued to one end of the core of a removable roll. This sleeve is preferably manufactured from plastic.

A particular embodiment is available whereby the foot of the plug is split so that two legs are formed. Each leg is equipped with a cam for clamping the plug into the sleeve along its longitudinal axis.

This sleeve and the freely-rotating plug are installed coaxially in relation to the tube length on at least one of the ends of this tube length. The plug must be installed in the the sleeve so that it is clamped along its longitudinal axis, and so that this securing method allows the plug to rotate freely in the sleeve.

The head of the plug is preferably equipped with a notch or recess which fits into a fixed attachment point on a roll-holder.

The head of the plug forms a fixed locking ring which has an internal diameter which is generally the same as the diameter of the core of the roll.

If the cardboard core of the roll is only provided on one side of a fitting-piece, the other end is possibly equipped with a plug or a sleeve equipped with a spindle on a fixed plug which can be inserted into a hole or a groove of a roll-holder by means of a plastic rod.

Two different attachment points in the roll-holder ensure that the user correctly installs the replacement rolls in the direction of rotation.

These specially-developed attachment points prevent other different types of rolls from being inserted into the apparatus. This ensures that a sales right is guaranteed for the purchase of replacement rolls.

These details and characteristics of the invention and also other characteristics are made apparent from the description of the associated schematic illustrations. These illustrations are examples which show an embodiment of the internal core element of the replacement roll, not as a restrictive example, according to the invention.

BRIEF DESCRIPTION OF THE DRAWINGS

In the drawings.

The same reference numbers are used in these figures for identical or similar parts.

DETAILED DESCRIPTION OF A PREFERRED EMBODIMENT

Figure 1:
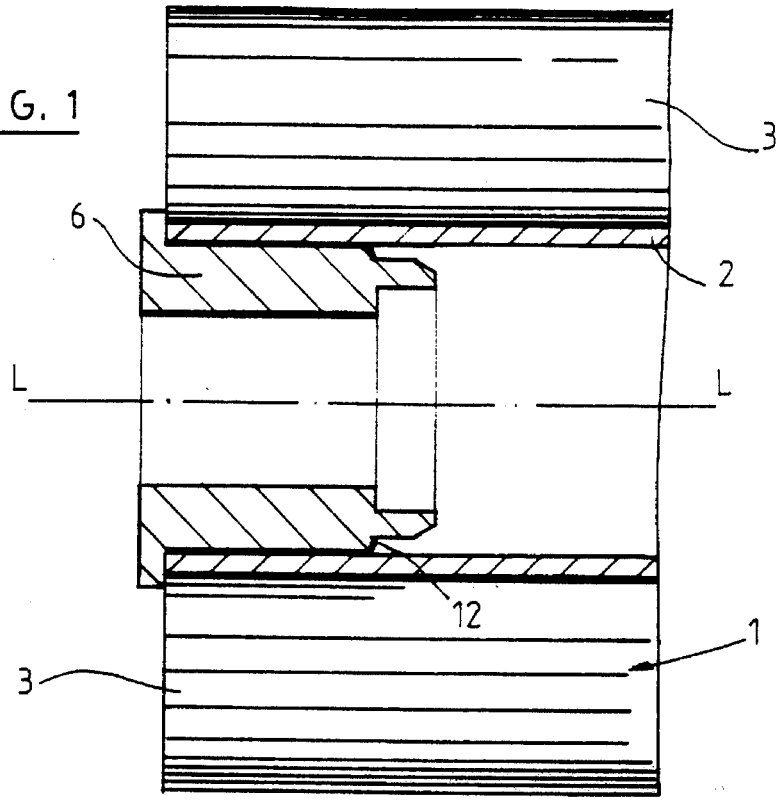
FIG. 1 is a longitudinal cross-sectional view of an internal paper roll whose core is equipped with a plug and a cover belonging to the connecting piece according to the invention.
Figure 2:
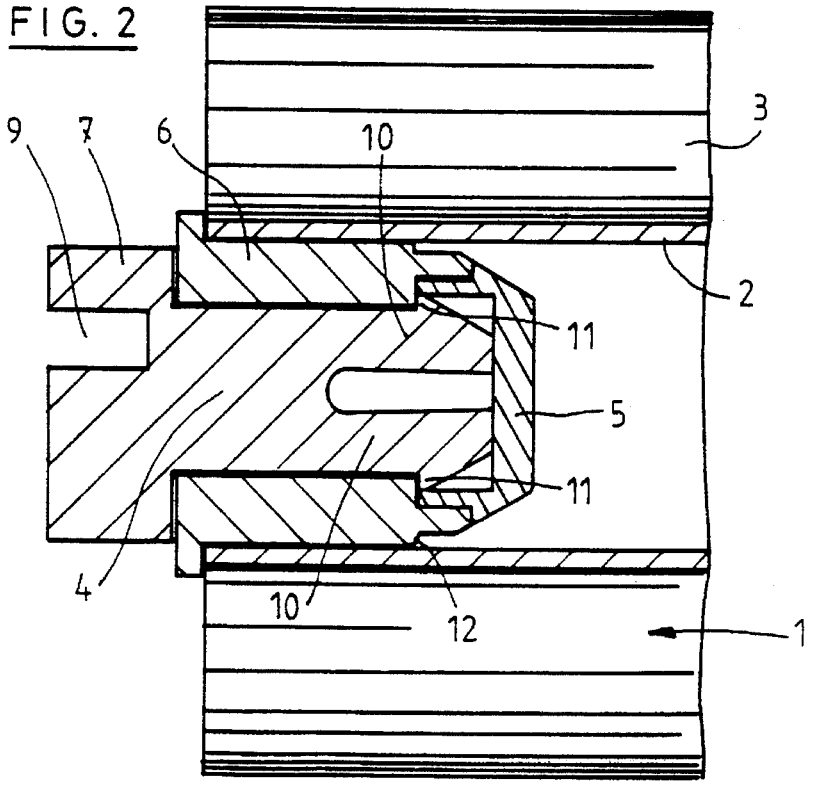
FIG. 2 is a longitudinal cross-sectional view, identical to FIG. 1, but with the addition of a freely-rotating plug.
Figure 3:
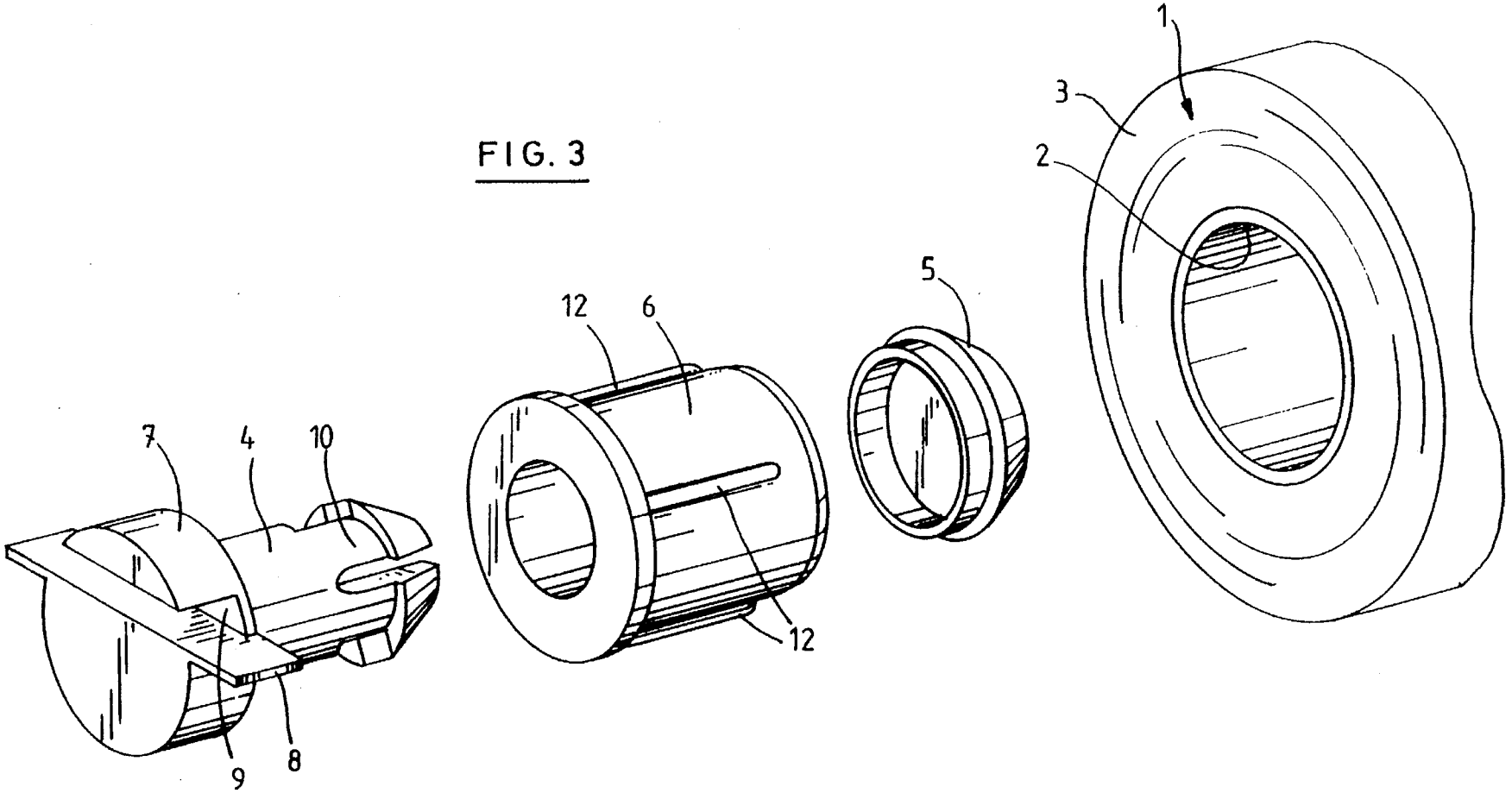
FIG. 3 is an exploded view of the connecting piece shown in FIGS. 1 and 2.

As shown in FIG. 1, a replacement roll 1 usually contains an internal core 2 consisting of a hollow cardboard tube which has a fixed diameter and onto which a roll of paper 3, plastic film or string is wound. The core 2 is possibly equipped with two raised edges whose purpose is to protect the edges of the paper roll. The roll 1 or drum rotates freely along its longitudinal axis L—L. Numerous systems exist for securing similar removable rolls in a roll-holder. Usually, a rod which is equipped with a nipple-shaped plug at each of the two ends, is slid through the core 2.

Each plug consists of a spindle which is positioned coaxially in relation to the end.

According to the invention, one of the nipple-shaped plugs is replaced by a cylindrical sleeve 6 in which a freely-rotating plug is located, the foot of which is equipped with elastically-suspended cams 11 in order to clamp the plug 4 in the sleeve 6 along the longitudinal axis. The sleeve 6 is provided with a circular collar 14 which encloses the edges of the core 2.

An additional characteristic of the invention is that the head 7 of the plug 4 is equipped with a lug 8 or recess 9 which fits exactly into a fixed attachment point of the roll-holder. The head 7 of the plug 4 is firmly fastened so that it acts as a bearing for the freely-rotating sleeve 6 and mandrel 2 of the paper roll 1 along its longitudinal axis L—L.

The plug is split along its length, in such a way that two legs 10 are formed, each of which has a cam 11 which clamps the plug 4 in the sleeve 6 along the longitudinal axis.

In order to prevent any random roll (which is equipped with a lug 8 or a recess 9 on at least one end of the above-mentioned head) from being placed onto a rod, the dimensions of the above-mentioned head are large enough to prevent it from being inserted into the core 2 of the paper roll 1.

The sleeve 6 has ribs 12 along its longitudinal axis and a flat end to which a blanking cap 5 is fitted. This blanking cap 5 prevents any glue which is applied from entering the rotating section between the plug 4 and the sleeve 6.

It is clear that the invention is not solely limited to the embodiment shown. Numerous changes can be made to the shape of the notch(es) or recesses on the head of the freely-rotating plug. Other changes can also be made, with the proviso that these changes do not conflict with the subject of one of the following claims.

I claim:

1. A fitting piece for attaching and locking a replaceable roll, disc, reel, bobbin, spool, wheel, drum or like rotatable object in a holder therefor, the object having a hollow core and two end spindles and the holder having attachment points for securing the spindles of the object for free rotation;

said fitting piece being characterized by at least one of said spindles comprising:

(A) a cylindrical sleeve for gluing to one end of the core of the object for rotation with the object as a unit, said sleeve having a longitudinal axis;

(B) a plug releasably and freely rotatably mounted in said sleeve, said plug having a longitudinal axis, a head and a foot, said foot defining means for releasably clamping said plug along said sleeve longitudinal axis, and said head defining means for fitting in a specific manner into a respective one of the attachment points of the holder; and (C) a blanking cap means mounted on said sleeve for preventing any glue applied between said sleeve and said plug core from blocking relative rotation of said sleeve and said plug.

2. The fitting piece of claim 1 wherein said clamping means is an elastically-suspended clamp.

3. The fitting piece of claim 1 wherein said fitting means is a lug or recess.

4. The fitting piece of claim 1 wherein said plug head is split along said plug longitudinal axis to form two legs, each leg having a cam which clamps said plug in said sleeve along said sleeve longitudinal axis.

5. The fitting piece of claim 1 wherein said plug head has an external diameter wider than the internal diameter of said sleeve.

6. A replacement roll, disc, reel, bobbin, spool, wheel drum or like rotatable object equipped with the fitting piece of claim 1.

* * * * *